US010015994B2

(12) United States Patent
Daryani et al.

(10) Patent No.: US 10,015,994 B2
(45) Date of Patent: Jul. 10, 2018

(54) ELECTRONIC SMOKING DEVICE WITH FLAVOR CARRYING UNITS

(71) Applicant: FONTEM HOLDINGS 1 B.V., Amsterdam (NL)

(72) Inventors: Neha Daryani, Hamburg (DE); Nicole Tschierske, Hamburg (DE); Lik Hon, Beijing (CN)

(73) Assignee: Fontem Holdings 1 B.V., Amsterdam (NL)

( * ) Notice: Subject to any disclaimer, the term of this patent is extended or adjusted under 35 U.S.C. 154(b) by 0 days.

(21) Appl. No.: 15/513,464

(22) PCT Filed: Sep. 21, 2015

(86) PCT No.: PCT/EP2015/071573
§ 371 (c)(1),
(2) Date: Mar. 22, 2017

(87) PCT Pub. No.: WO2016/046116
PCT Pub. Date: Mar. 31, 2016

(65) Prior Publication Data

US 2017/0238612 A1 Aug. 24, 2017

(30) Foreign Application Priority Data

Sep. 23, 2014 (EP) ..... 14185932

(51) Int. Cl.
*A24B 15/00* (2006.01)
*A24F 47/00* (2006.01)

(52) U.S. Cl.
CPC ..... *A24F 47/008* (2013.01)

(58) Field of Classification Search
CPC ..... A61M 15/06; A61M 15/00; A61M 11/06; A24F 47/002; A24F 47/008
(Continued)

(56) References Cited

U.S. PATENT DOCUMENTS 5,150,722 A * 9/1992 Rutherford ..... A01K 55/00 131/231
5,845,649 A * 12/1998 Saito ..... A24B 15/165 131/194

(Continued)

FOREIGN PATENT DOCUMENTS

WO 2014140320 A1 9/2014

OTHER PUBLICATIONS

European Patent Office, Search Report and Search Opinion for EP14185932.2, dated Mar. 16, 2015.

(Continued)

*Primary Examiner* — Tho D Ta
*Assistant Examiner* — Thang Nguyen
(74) *Attorney, Agent, or Firm* — Perkins Coie LLP

(57) ABSTRACT

An electronic smoking device (1) includes a mouthpiece (2), a heating element (4) and a body portion (5) which contains a liquid reservoir (6). The heating element (4) is adapted to vaporize liquid (7) supplied from the reservoir (6) to generate an aerosol. A flow path (8) extends from the heating element (4) to the mouthpiece (2). Flavor carrying units (9, 10) are permeable to the vaporized liquid (7) and carry flavored material (11, 12). The flavored material is selectively and individually exposed to the flow path 8 creating a flavored aerosol.

19 Claims, 2 Drawing Sheets

(58) Field of Classification Search
USPC ..... 131/274, 280, 231, 328
See application file for complete search history.

(56) References Cited

U.S. PATENT DOCUMENTS

| | | | | |
|---|---|---|---|---|
| 5,901,710 | A * | 5/1999 | Barber | A24F 25/00 131/274 |
| 8,550,069 | B2 * | 10/2013 | Alelov | A61M 11/005 128/202.21 |
| 9,491,974 | B2 * | 11/2016 | DePiano | A24F 47/008 |
| 9,682,204 | B2 * | 6/2017 | Matsumoto | A61M 15/06 |
| 2008/0149119 | A1 * | 6/2008 | Marquez | A24B 15/283 131/203 |
| 2012/0048266 | A1 | 3/2012 | Alelov | |
| 2012/0138075 | A1 * | 6/2012 | Jespersen | A24C 5/40 131/280 |
| 2013/0019884 | A1 * | 1/2013 | Sashide | A24B 15/283 131/276 |
| 2013/0160780 | A1 * | 6/2013 | Matsumoto | A24F 47/002 131/329 |
| 2013/0319430 | A1 * | 12/2013 | Tanaka | A24B 3/14 131/275 |
| 2014/0000638 | A1 | 1/2014 | Sebastian | |
| 2016/0135506 | A1 * | 5/2016 | Sanchez | A24F 47/008 131/329 |
| 2017/0246407 | A1 * | 8/2017 | Matsumoto | A24F 47/002 |

OTHER PUBLICATIONS

European Patent Office, Search Report for PCT/EP2015/071573, dated Nov. 23, 2015.

* cited by examiner

ELECTRONIC SMOKING DEVICE WITH FLAVOR CARRYING UNITS

BACKGROUND OF THE INVENTION

An electronic smoking device, e.g. designed as an electronic cigarette, generally has a housing containing an electric power source (usually a single use battery or a rechargeable battery), and an electrically operable atomizer. The atomizer vaporizes or atomizes liquid supplied from a reservoir (usually a capsule) and provides vaporized or atomized liquid as an aerosol. Control electronics controls activation of the atomizer. In many electronic cigarettes, a puff detector is provided within the electronic smoking device which detects a user puffing on the device (e.g., by sensing an under-pressure or an air flow pattern through the device). The puff detector indicates or signals the puff to the control electronics. Alternatively, a button may be used to switch on the electronic smoking device to generate a puff of flavour. When a puff is detected, the control electronics supplies electrical power to the atomizer thereby creating vaporized liquid as an aerosol.

Electronic smoking devices which provide a certain flavour or a flavoured aerosol are increasingly popular. However to change the flavour the user has to exchange the flavoured liquid contained within the device. This can be time-consuming and can unnecessarily interfere with the enjoyment of the device. A change of the flavour by changing the flavoured liquid in the atomizer may also be hampered as the previous flavour persists in the wick and therefore different flavours may overlap without intention.

SUMMARY OF THE INVENTION

In one aspect of the present invention, an electronic smoking device is provided which comprises a mouthpiece, an atomizer and a body portion with a reservoir for storing liquid for atomization. The atomizer is adapted to generate an aerosol by vaporizing liquid supplied from the reservoir. A flow path arranged to receive aerosols generated by the atomizer extends from the atomizer to the mouthpiece. Flavour carrying units are permeable to an aerosol generated by the atomizer. The flavour carrying units may include an upper holder and a lower holder that are attachable to one another and adapted to enclose a flavoured material. The electronic smoking device allows a user to easily charge the first and second flavour carrying units with specific flavoured materials.

Characteristics, features and advantages of this present invention and the manner in which they are obtained as described above, will become more apparent and be more clearly understood in connection with the following description of exemplary embodiments, which are explained with reference to the accompanying drawings.

DETAILED DESCRIPTION OF THE DRAWINGS

Figure 1:
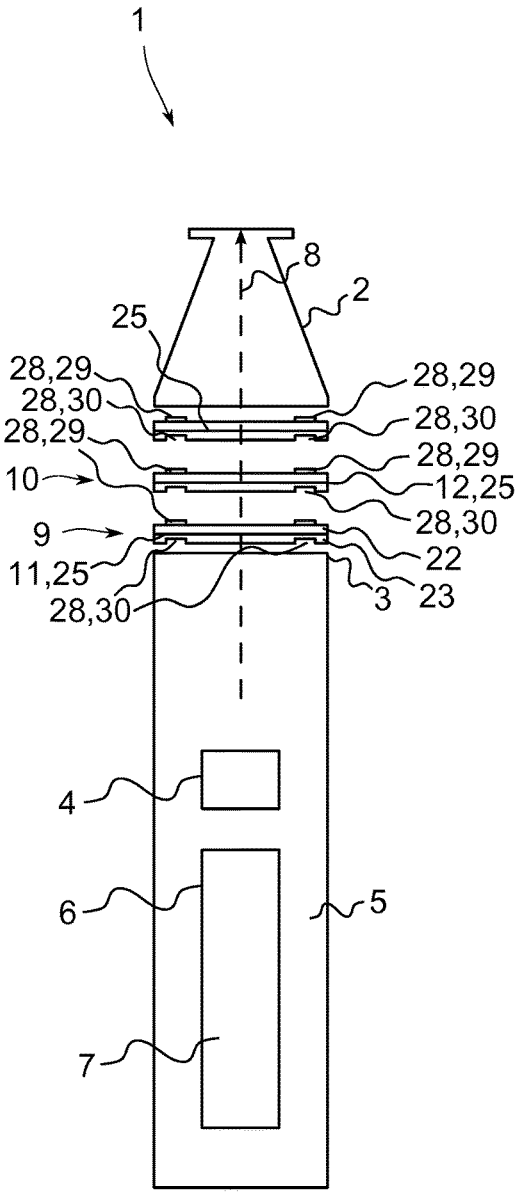
FIG. 1 is a schematic exploded view of an electronic smoking device according to an embodiment of the present invention.

In FIG. 1 an electronic smoking device 1 has a mouthpiece 2 which is attached to a first end 3 of a body portion 5 of the electronic smoking device 1. Flavour carrying units 9, 10 are positioned between the body portion 5 and the mouthpiece 2.

The mouthpiece 2 may be in the form of a cone while the body portion 5 has a substantially cylindrical and tubular shape. The body portion 5 functions as a housing and contains a heating element 4 and a reservoir 6 for storing liquid 7. The heating element 4 is adapted to vaporize the liquid 7 supplied from the reservoir 6. The heating element 4 may be provided as a heating coil arranged between the reservoir 6 and a first end 3 of the body portion 5.

The reservoir 6 may be a capsule arranged adjacent to the heating element 4 and filled with a liquid 7. However, the reservoir 6 also may be any other kind of receptacle such as a tank system that can have an arbitrary form or shape and also be located in another position inside the body portion 5. The liquid 7 may be flavoured or flavourless and may include glycerol. However, the liquid 7 may also include propylene glycol, triethylene glycol, polyhydric alcohol, tetraethylene glycol, aliphatic ester of carboxylic acid, such as methyl stearate, dimethyl dodecanedioate, dimethyl tetradecanedioate, water and the like. When triggered by a user of the electronic smoking device 1, liquid 7 is released from the reservoir 6 and provided to the heating element 4 where it is vaporized. After vaporization, the vaporized liquid 7 is guided to the mouthpiece 2. In order to reach the mouthpiece 2, the vaporized liquid 7 has to pass the flavour carrying units 9, 10.

The electronic smoking device 1 accommodates a flow path 8 adapted to receive vaporized liquid 7, wherein the flow path 8 extends from the heating element 4 to the mouthpiece 2. As shown in FIG. 1, an opening is arranged within a cap part which is located at the first end 3 of the body portion 5 facing the flavour carrying units 9, 10 which represents an outlet for vaporized liquid 7 and which defines a cross section of the flow path 8.

The electronic smoking device 1 may include a first flavour carrying unit 9 and a second flavour carrying unit 9, 10 for carrying a flavoured material 11, 12 respectively. The flavour carrying units 9, 10 are permeable to the vaporized liquid 7 generated by the heating element 4.

The first and second separate flavour carrying units 9, 10 may carry different flavoured materials 11, 12, for example where the first flavoured material 11 is a menthol extract and the second flavoured material 12 is a vanilla extract. However, any kinds of flavoured materials 11, 12 may be carried by the first and second flavour carrying units 9, 10. These other materials may include esters, such as isoamyl acetate, linalyl acetate, isoamyl propionate, linalyl butyrate and the like; natural essential oils as plant essential oils, such as spearmint, peppermint, cassia, jasmine and the like; animal essential oils, such as musk, amber, civet, castor and the like; simple flavouring materials, such as anethole, limonene, linalool, eugenol and the like; hydrophilic flavour components such as a leaf tobacco extract or natural plant flavouring materials such as licorice, St. John's wort, a plum extract, a peach extract and the like; acids such as a malic acid, tartaric acid, citric acid and the like; sugars such as glucose, fructose, isomerized sugar and the like; and polyhydric alcohols such as propylene glycol, glycerol, sorbitol and the like. Furthermore, it also possible to combine different flavoured materials of those mentioned above into new flavoured materials 11, 12. Moreover, it is possible to adsorb any flavour onto a solid material and to use this material as flavoured material 11, 12 within an electronic smoking device 1.

As shown in FIG. 1, the first and the second flavour carrying units 9, 10 may each have an upper holder 22 and a lower holder 23, which are attachable to one another and which enclose a flavoured material 11, 12 respectively. The upper holder 22 and the lower holder 23 may be formed as ring-shaped holders respectively, with the upper holders 22 having fasteners 24 to mechanically fix the upper holder 22 and the lower holder 23 to one another. The flavoured materials 11, 12 can be drawn from e.g. a foil and easily be interposed between the upper holder 22 and the lower holder 23 of the first and second flavour carrying units 9, 10 respectively, allowing the electronic smoking device 1 to be more easily manufactured. This design also allows the user to easily charge the first and second flavour carrying units 9, 10 with flavoured materials 11, 12.

The flavoured material 11, 12 may be formed as a flavoured glass fibre sheet 25 which is interposed between the upper holder 22 and the lower holder 23 and which has a circular shape. The flavoured glass fibre sheet 25 may be formed as a thin sheet with a uniform thickness. The sheet 25 may be 0.1 mm to about 2 or 3 mm thick. Providing very thin glass fibre sheets 25 allows for good penetration of the vaporized liquid 7 through the flavoured materials 11, 12 and therefore an efficient impregnation of the vaporized liquid 7 with the flavour of the respective flavoured material 11, 12. However, the flavoured material 11, 12 also can be provided in another form, for example as a cotton sheet, a filter paper sheet and the like. The fasteners 24 may be pins which penetrate the flavoured glass fibre sheet 25 and the lower holders 23 respectively, thereby attaching the upper holder 22 to the lower holder 23, enclosing the flavoured glass fibre sheets 25 between them. When ultrasonic is applied, the pins will melt and the three parts, namely the upper holder 22, the flavoured glass fibre sheet 25 and the lower holder 23 are attached together. However, also other fasteners 24 that serve to interconnect the upper holder 22 and the lower holder 23 of a flavour carrying unit 9, 10 may alternatively be used including metal pins or screws, clamps, clips, adhesives, etc.

The first and the second flavour carrying units 9, 10 may each also include attachment members 28 adapted to detachably fix the first and the second flavour carrying units 9, 10 to one another. The attachment members 28 may be provided as a protrusion 29 and a complimentary groove 30, with two or more protrusions 29 of the first flavour carrying unit 9 forcibly inserted into grooves 30 of the second flavour carrying unit 10. In this way, the flavours of the flavoured materials 11, 12 can easily be combined by connecting the first and the second flavour carrying unit 9, 10 with each other, using the press-fit connection provided by the combination of the protrusions 29 and the grooves 30.

A user can for example connect the first flavour carrying unit 9 with the end 3 of the body portion 5 which is facing towards the mouthpiece 2. The user can combine the flavour of the flavoured material 11 contained within the first flavour carrying unit 9 with the flavour of the flavoured material 12 contained within the second flavour carrying unit 10 by attaching the second flavour carrying unit 10 onto the first flavour carrying unit 9, using the press-fit connection provided by the attachment members 28, inserting the attachment protrusions 29 into the attachment grooves 30. The user can further combine the resulting flavour with another flavour of a flavoured material contained in a third (upper) flavour carrying unit comprising another flavoured glass fibre sheet 25 and so on. Hence the user can configure the device to provide a plurality of different flavours by stacking a multitude of different flavoured materials 11, 12 enclosed within the ring holders 22, 23 of the flavour carrying units 9, 10. The vaporized liquid 7 generated within the body portion 5 easily penetrates through the thin flavoured glass fibre sheets 25 enclosed within the flavour carrying units 9, 10. In FIG. 1, the course of the flow path 8 is indicated by a dashed line.

Figure 2A:
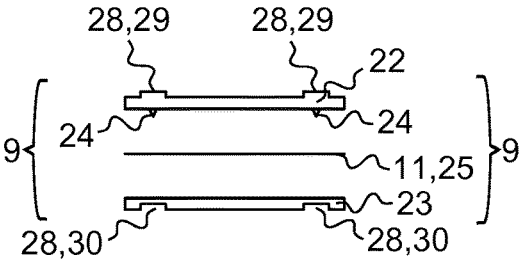
FIG. 2A is a schematic exploded side view of a carrier unit as used in the electronic smoking device shown in FIG. 1.
Figure 2B:
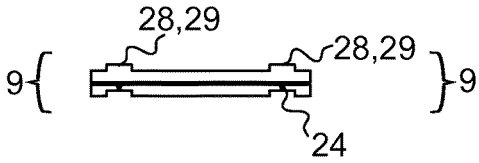
FIG. 2B is a schematic assembled side view of the carrier unit shown in FIG. 2A.

FIGS. 2A and 2B show a schematic exploded side view and an assembled side view of a flavour carrying unit 9. In FIG. 2A, the upper holder 22 with the attachment members 28 is shown detached from the flavoured glass fibre sheet 25 and from the lower holder 23. In FIG. 2B, the upper holder 22, the flavoured glass fibre sheet 25 and the lower holder 23 are connected to one another. Although two fasteners 24 are shown, of course designs using more or less than two fasteners may also be used.

Figure 2C:
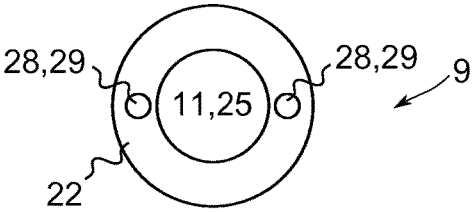
FIG. 2C is a schematic assembled top view the carrier unit shown in FIGS. 2A and 2B, FIG. 3A a schematic exploded side view of another carrier unit as used in the electronic smoking device shown in FIG. 1.

FIG. 2C shows a schematic assembled top view of a flavour carrying unit 9 with an open circular area of the flavoured glass fibre sheet 25 which is neither covered by the upper holder 22 nor by the lower holder 23. Accordingly, the vaporized liquid 7 can easily penetrate the flavoured glass fibre sheet 25 of the stacked flavour carrying units 9, 10. The open circular area may have a diameter ranging from 40 to 80% of the diameter of the holder 22.

Figure 3A:
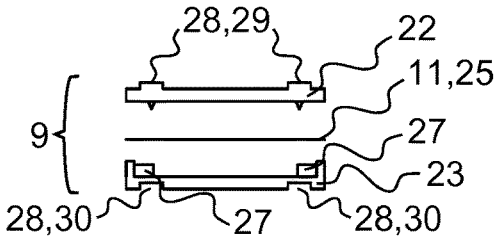
FIG. 3B is a schematic exploded top view of the carrier unit shown in FIG. 3A, and FIG. 4 a schematic assembled side view of another carrier unit design.
Figure 3B:
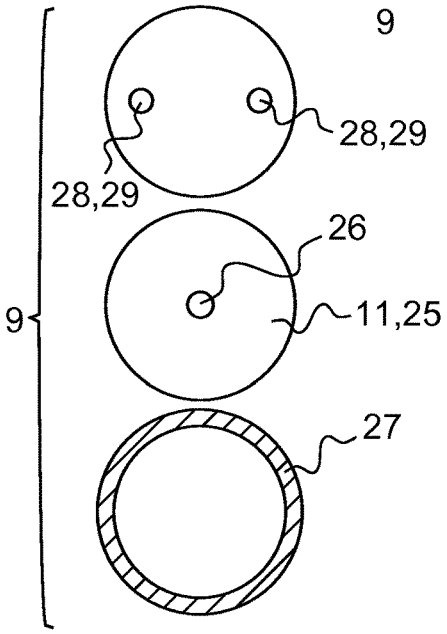

FIGS. 3A and 3B show a schematic exploded side view and an exploded top view of a second embodiment of a first flavour carrying unit 9 which may be the same as the first flavour carrying unit 9 as shown in FIGS. 2A, 2B and 2C except as described below.

As shown in FIGS. 3A and 3B, a flavoured gasket element 27 may be provided in the shape of a ring or an O-ring, with the gasket element 27 positioned within the lower holder 23 of the first flavour carrying unit 9. The flavoured gasket element 27 additionally serves to impregnate the vaporized liquid 7 with flavour. In the second embodiment shown in FIGS. 3A and 3B, the flavoured glass fibre sheet 25 may have at least one air flow hole 26 which is preferably located in the central portion of the flavoured glass fibre sheet 25. This may be preferred when a large multitude of flavour carrying units 9, 10 are stacked. With air flow holes 26 provided in the flavoured glass fibre sheets 25, vaporized liquid 7 more easily penetrates all the flavoured glass fibre sheets 25 of the flavour carrying units 9, 10. A pattern of smaller holes 26 in the sheet 25 may also be used in addition to or in place of a single central hole 26.

Figure 4:
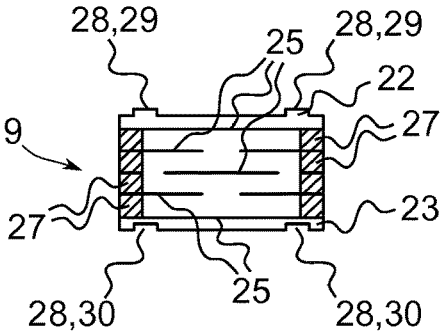

FIG. 4 shows a schematic assembled side view of a third embodiment of a flavour carrying unit 9 which may be the same as the other embodiments, except that, four flavoured gasket elements 27 and five flavoured glass fibre sheets 25 are incorporated inside the first flavour carrying unit 9 by stacking them above one another between the upper and the lower holder 22, 23. Furthermore, each of the flavoured glass fibre sheets 25 is enclosed between two flavoured gasket elements 27 respectively, wherein the flavoured gasket elements 27 are also provided as O-ring gaskets as shown in FIG. 3B.

FIG. 4 shows that several flavoured glass fibre sheets 25 can be stacked together and each of them can vary. Each flavoured glass fibre sheet 25 has its own gasket 27 and my have different size and number of holes in order to provide a longer airflow, allowing the aerosol to collect more flavour.

In FIG. 4, the flavoured glass fibre sheets 25 are stacked vertically. The number and arrangements of flavoured gasket elements 27 and flavoured glass fibre sheets 25 may of course be varied. With the flavour carrying units 9, 10 stacked together, a longer path for the vaporized liquid 7 is created, which results in more flavour collected in the pathway 8 towards the mouthpiece 2. The design of FIG. 4 consequently allows increasing the amount of flavour stored within the flavour carrying unit 9, 10 and enables a constant and enduring delivery of flavour.

More than a first and a second flavour carrying unit 9, 10 may be used. More than one disc can be stacked together and the airflow is forced to pass through these. There is obviously a limit as the discs have a potential to capture the aerosol. The discs have a Lego-like effect as shown in FIG. 3A due to protrusions 29 and complimentary grooves 30. For example, the electronic smoking device 1 may include 3, 4, 5, 6, 7, 8, 9 or 10 or even more flavour carrying units 9, 10. Nicotine may be stored within the first and/or the second flavour carrying unit 9, 10, wherein the nicotine is impregnated into the vaporized liquid 7 when the electronic smoking device 1 is in use. The nicotine can be contained within the flavoured material 11, 12. For example, a flavoured material 11, 12 can comprise 94% of a carrying material, 4% of flavour and 2% of nicotine, optionally with other compositions and concentrations. The nicotine can also be stored in a base liquid and the discs can only be used for flavour.

A holder may be adapted to assemble a first and/or a second flavour carrying unit 9, 10, wherein the holder substantially has the shape of a gripper. Alternatively a blister package may be used including a plurality of blisters containing flavoured material 11, 12. In this case the blisters may be arranged uniformly within the blister package and sealed against the ingress of moisture.

Although in the above embodiments electronic smoking devices have been described in which liquid is atomized by being heated by an electric heater, it will be appreciated that in other embodiments other means for generating a vapour such as the use of piezo-electric elements could be used.

It will also be appreciated that although in some embodiments a puff detector for detecting a user puffing on a device could be provided and the puff detector could be arranged to initiate the activation of an atomizer when a user puffed on the device, in some embodiments the puff detector may be replaced by a push button. In this case the user activates the atomizer by pressing the button. In other embodiments other means for activating the device could be provided.

While this present invention has been described in connection with what is presently considered to be practical exemplary embodiments, it is to be understood that the present invention is not limited to the disclosed embodiments, but, on the contrary, is intended to cover various modifications and equivalent arrangements included within the scope of the appended claims.

LIST OF REFERENCE SIGNS

1 electronic smoking device
2 mouthpiece
3 first end
4 heating element
5 body portion
6 reservoir
7 liquid
8 flow path
9 first flavour carrying unit
10 second flavour carrying unit
11 first flavoured material
12 second flavoured material
22 upper holder
23 lower holder
24 fastening member
25 flavoured glass fibre sheet
26 air flow hole
27 flavoured gasket element
28 attachment member
29 attachment protrusion
30 attachment groove

The invention claimed is:

1. An electronic smoking device, comprising:
a body portion;
a mouthpiece;
an atomizer in the body portion;
a liquid reservoir in the body portion wherein the atomizer is adapted to vaporize liquid supplied from the reservoir to generate an aerosol;
a flow path extending from the atomizer to the mouthpiece; and
a plurality of flavor carrying units each operable to carry flavoring material;
wherein the flavor carrying units are permeable to an aerosol generated by the atomizer, and wherein each of the plurality of flavor carrying units comprises a first holder and a second holder attachable to one another and adapted to enclose the flavoring material;
wherein one end of the plurality of flavor carrying units is attached to an end of the body portion and the other end of the plurality of flavor carrying units is attached to the mouthpiece.

2. The electronic smoking device of claim 1, wherein the first and second holders comprise ring-shaped holders respectively, wherein at least one of the ring-shaped holders includes one or more fasteners adapted to mechanically fix the first holder and the second holder to one another.

3. The electronic smoking device of claim 1, wherein the flavoring material comprises a flavored glass fibre sheet interposed between the first holder and the second holder.

4. The electronic smoking device of claim 3, wherein the flavored glass fibre sheet has a circular shape, wherein a diameter of the glass fibre sheet is smaller than or equal to a diameter of the first holder.

5. The electronic smoking device of claim 3, wherein the flavored glass fibre sheet comprises at least one air flow hole.

6. The electronic smoking device of claim 5, wherein the air flow hole is located in a central portion of the flavored glass fibre sheet.

7. The electronic smoking device of claim 1, further comprising a flavored gasket element.

8. The electronic smoking device of claim 7, wherein the flavored gasket element is ring-shaped.

9. The electronic smoking device of claim 8, wherein the second holder comprises a side wall located in a peripheral portion of the first holder, wherein an outer diameter of the flavored gasket element is smaller than or equal to an inner diameter of the second holder.

10. The electronic smoking device of claim 9, wherein a height of the side wall of the second holder is greater than or equal to a thickness of the flavored gasket element.

11. The electronic smoking device of claim 8 wherein an outer diameter of the flavored gasket element is greater than or equal to a diameter of the glass fibre sheet.

12. The electronic smoking device of claim 11, wherein a thickness of the flavored gasket element is greater than a thickness of the glass fibre sheet.

13. The electronic smoking device of claim 1 wherein each of the first and the second flavor carrying units comprises at least one attachment member adapted to detachably fix the first and the second flavor carrying units to one another.

14. The electronic smoking device of claim 13, wherein the attachment members of the first and second flavor carrying units each comprise at least one attachment protrusion and at least one attachment groove, wherein the attachment protrusion of the first flavor carrying unit is adapted to be forcibly inserted into the attachment groove of the second flavor carrying unit.

15. An electronic atomization device, comprising:

a housing;

a liquid reservoir in the housing;

an atomizer in the housing;

a flow path in the housing extending from the atomizer to a mouthpiece; and first and second flavor carrying units permeable to an aerosol generated by the atomizer, each flavor carrying unit comprising a first holder attachable to a second holder to enclose a flavoring material;

wherein the flavor carrying units are between the atomizer and the mouthpiece; and the first flavor carrying unit is attached to the second flavor carrying unit, with the first flavor carrying unit attached to the housing and the second flavor carrying unit attached to the mouthpiece.

16. The electronic atomization device of claim 15 wherein each flavor carrying unit is ring-shaped.

17. The electronic atomization device of claim 16 wherein the flavor carrying units are external of the housing.

18. The electronic atomization device of claim 15 with the atomizer including an electric heater.

19. The electronic atomization device of claim 15 with each flavor carrying unit including a permeable fiber material.

* * * * *